US007837506B1

(12) United States Patent
Chiang et al.

(10) Patent No.: US 7,837,506 B1
(45) Date of Patent: Nov. 23, 2010

(54) ELECTRICAL CONNECTOR

(75) Inventors: Shu-Man Chiang, Taipei (TW); Yung-Chi Peng, Taipei (TW); Sheng-Nan Yu, Taipei (TW)

(73) Assignee: Cheng Uei Precision Industry Co., Ltd., Taipei (TW)

( * ) Notice: Subject to any disclaimer, the term of this patent is extended or adjusted under 35 U.S.C. 154(b) by 0 days.

(21) Appl. No.: 12/763,212

(22) Filed: Apr. 20, 2010

(51) Int. Cl.
*H01R 13/648* (2006.01)

(52) U.S. Cl. ..... 439/607.27; 439/607.36

(58) Field of Classification Search ..... 439/607.27, 439/607.36
See application file for complete search history.

(56) References Cited

U.S. PATENT DOCUMENTS 5,928,035 A * 7/1999 Jankowsky et al. ..... 439/607.36
6,379,184 B1 * 4/2002 Bassler et al. ..... 439/607.27
7,661,990 B1 * 2/2010 Chiang ..... 439/607.35
D618,622 S * 6/2010 Chiang et al. ..... D13/147

* cited by examiner

*Primary Examiner*—James Harvey

(57) ABSTRACT

An electrical connector includes an inner shell which defines a receiving recess and has a base board, an insulating body which defines a receiving chamber with a front end being opened freely for receiving the inner shell therein, a plurality of terminals insert-molded in the insulating body and exposed to the receiving recess, and an outer shell which encloses the insulating body and has a base plate. A connecting slot is opened in and penetrates through a rear wall of the receiving chamber. A rear edge of the base board is provided with a contact slice passing through the connecting slot and then bent against the rear wall. A rear edge of the base plate is bent downward and then arched forward to form a contact tail which is located behind the rear wall and electrically abuts against the contact slice to achieve a ground function of the inner shell.

3 Claims, 4 Drawing Sheets

ELECTRICAL CONNECTOR

BACKGROUND OF THE INVENTION

1. Field of the Invention

The present invention relates to an electrical connector, and more particularly to an electrical connector having a water-proof function.

2. The Related Art

A conventional electrical connector includes an insulating body, a plurality of terminals disposed in the insulating body, and a shell mounted around the insulating body. The shell is made of a metal sheet and shows a box shape to define a receiving recess therein. The insulating body has a base portion mated with a rear of the receiving recess of the shell, and a tongue portion extended forward from the base portion into a front of the receiving recess. The shell has a base board of which two opposite side edges are respectively provided with a soldering tail for being soldered to a printed circuit board. The base board further defines a buckling hole penetrating therethrough for locking a corresponding buckling portion of a mating connector therein. However, the water entering the receiving recess from an opened front end mouth of the receiving recess is apt to further flow onto the printed circuit board through the buckling hole or along the soldering tail to damage the printed circuit board. Therefore, an electrical connector capable of overcoming the foregoing problems is required.

SUMMARY OF THE INVENTION

It is an object of the present invention to provide an electrical connector having a water-proof function. The electrical connector includes an inner shell, an insulating body, a plurality of terminals and an outer shell. The inner shell defines a receiving recess with two opposite ends being opened freely. A base board, two side boards and a connecting board are formed around the receiving recess. A rear edge of the base board is provided with a contact slice. The insulating body defines a receiving chamber with a front end being opened freely for receiving the inner shell therein. A middle of a rear wall of the receiving chamber protrudes forward into the receiving recess of the inner shell to form a tongue. A connecting slot is opened in a top of the rear wall and penetrates through the rear wall. The contact slice of the inner shell passes through the connecting slot and then is bent against a rear surface of the rear wall. Each of the terminals has a contact arm insert-molded in the tongue of the insulating body and exposed to the receiving recess of the inner shell, and a soldering arm stretching out of the rear wall. The outer shell encloses the insulating body and has a base plate. A portion of a rear edge of the base plate is bent downward and then arched forward to form a contact tail which is located behind the rear wall and electrically abuts against the contact slice of the inner shell to achieve a ground function of the inner shell through the outer shell.

As described above, the electrical connector of the present invention can effectively prevent the water, which enters the receiving recess of the inner shell from an opened front end mouth of the receiving recess, from flowing onto a printed circuit board by means of the inner shell being wrapped in the receiving chamber of the insulating body. Moreover, the contact slice stretches out of the insulating body to contact the contact tail so as to achieve the ground function of the inner shell through the outer shell, so that further prevent the water from flowing onto the printed circuit board along the contact slice.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 2:
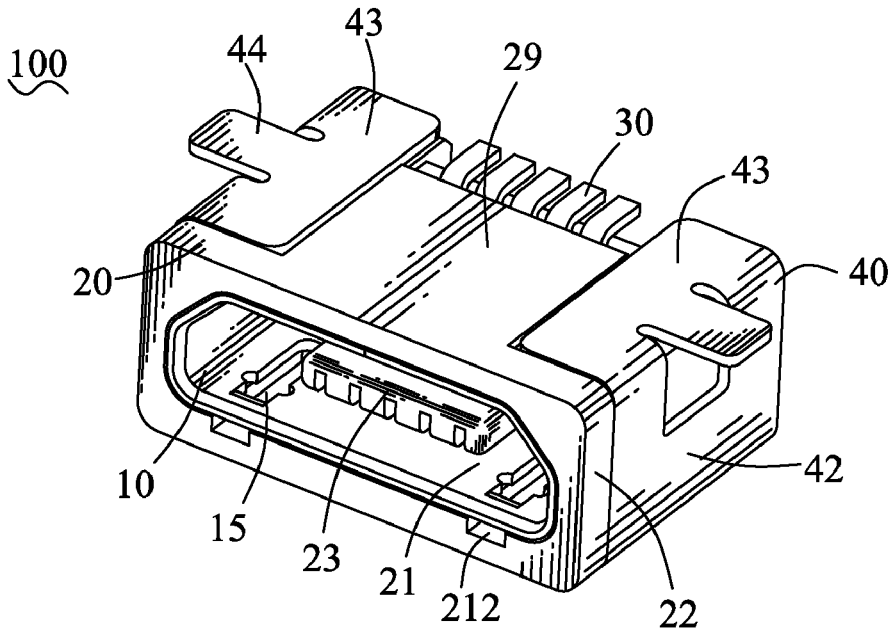
FIG. 2 is an assembled perspective view of the electrical connector of FIG. 1 viewed from another angle.
Figure 3:
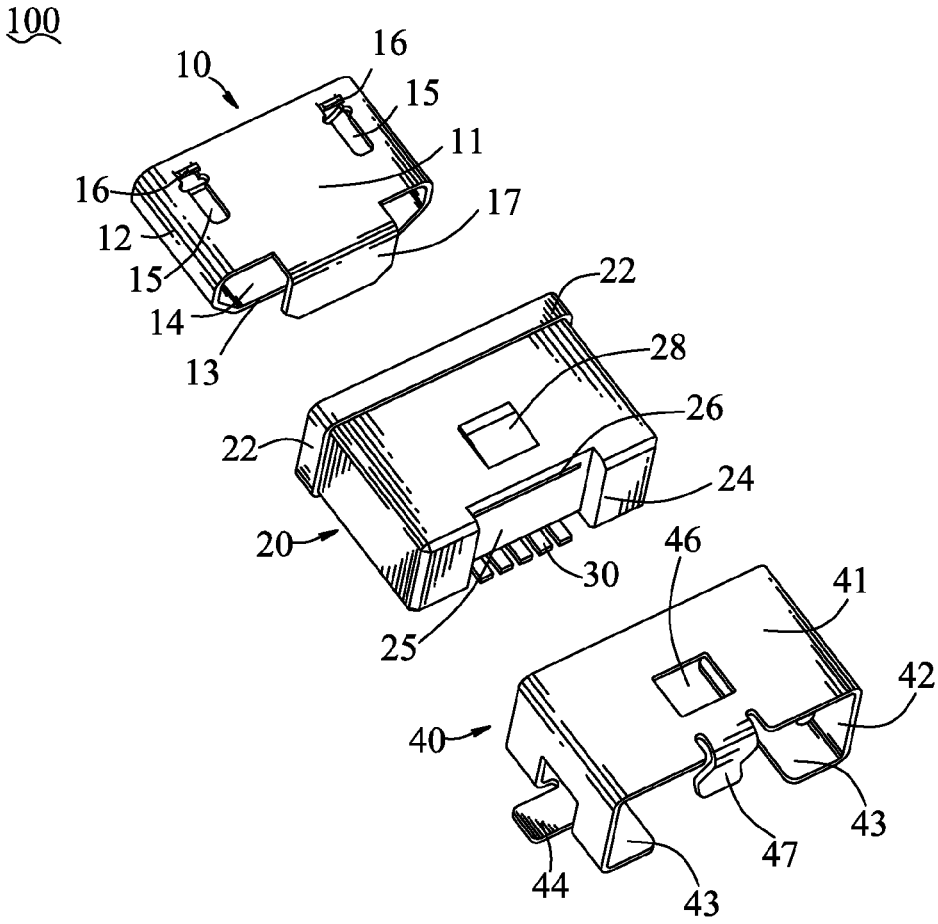
FIG. 3 is an exploded perspective view of the electrical connector of FIG. 1.

Referring to FIG. 2 and FIG. 3, an electrical connector 100 according to the present invention includes an inner shell 10, an insulating body 20, a plurality of terminals 30 integratedly molded in the insulating body 20, and an outer shell 40 mounted around the insulating body 20.

Figure 4:
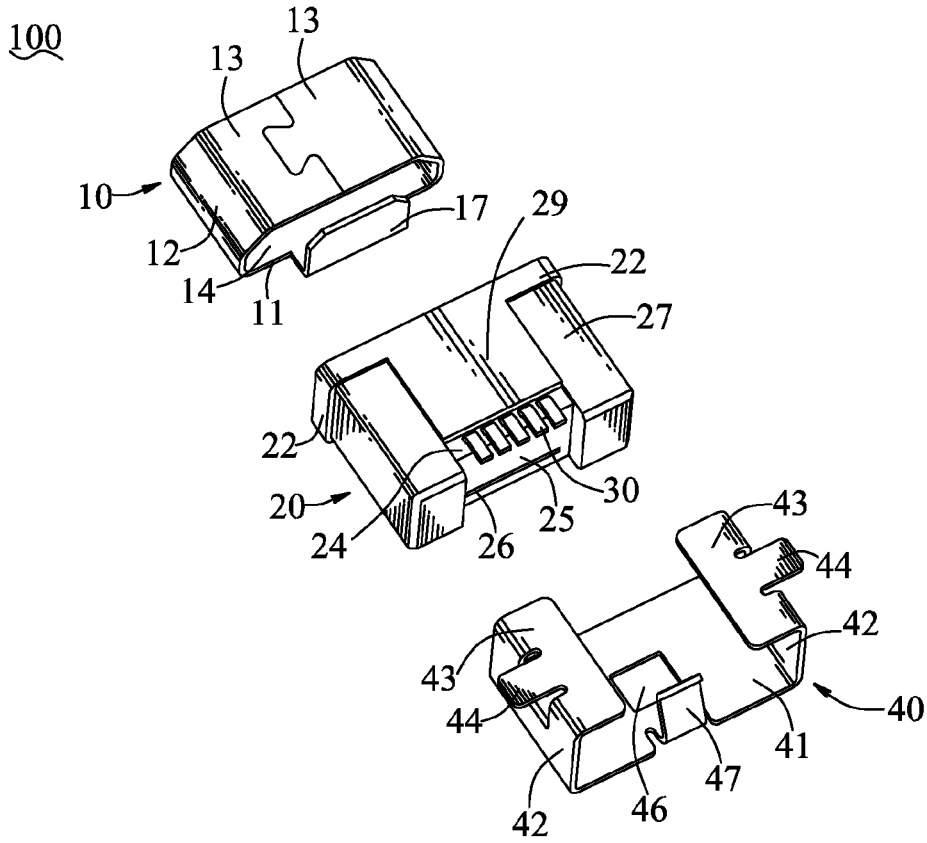
FIG. 4 is an exploded perspective view of the electrical connector of FIG. 1 viewed from another angle.

Referring to FIG. 3 and FIG. 4, the inner shell 10 has a rectangular base board 11. Two opposite side edges of the base board 11 extend downward and then are inclined toward each other to form two side boards 12 facing each other. Two bottom edges of the side boards 12 horizontally extend toward each other to form a pair of connecting boards 13 engaged with each other. A receiving recess 14 is formed among the base board 11, the two side boards 12 and the two connecting boards 13. Two opposite sides of a front of the base board 11 respectively define a fillister 15 vertically penetrating therethrough to communicate with the receiving recess 14. A front edge of the fillister 15 extends upward to form a locking portion 16 opposite to the receiving recess 14. A middle of a rear edge of the base board 11 is bent downward to form a contact slice 17 facing the receiving recess 14.

Figure 5:
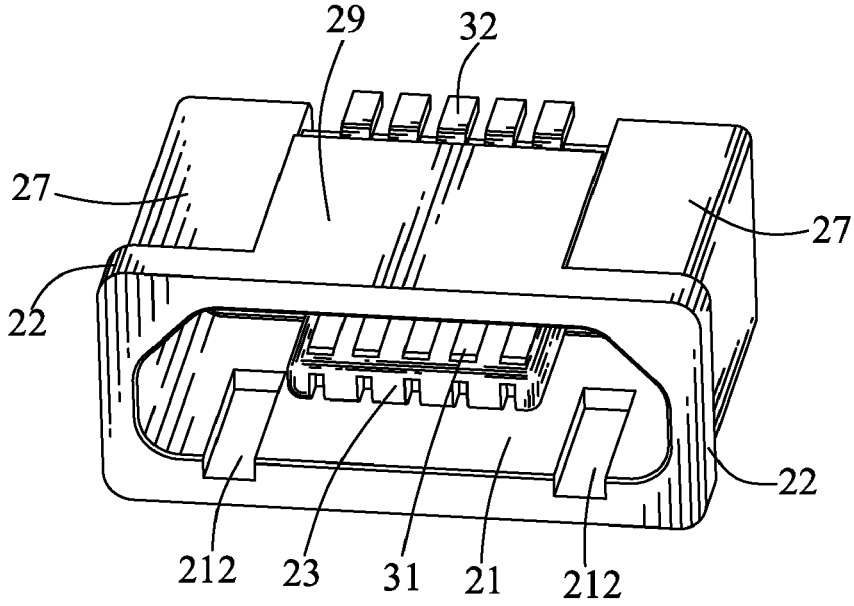
FIG. 5 is a perspective view of an insulating body with a plurality of terminals of the electrical connector of FIG. 1.

Referring to FIG. 3, FIG. 4 and FIG. 5, the insulating body 20 is of rectangular shape. A middle of the insulating body 20 defines a substantially rectangular receiving chamber 21 passing through a front surface thereof. A middle of a rear surface of the insulating body 20 is concaved inward to form a rectangular receiving cavity 25. There is a connecting slot 26 opened in a top of a rear wall 24 of the receiving chamber 21 and penetrating through the rear wall 24 to connect the receiving chamber 21 and the receiving cavity 25. The connecting slot 26 is adjacent to a top inside of the receiving chamber 21. A middle of the rear wall 24 of the receiving chamber 21 protrudes forward into the receiving chamber 21 to form a tongue 23 apart from insides of the receiving chamber 21. Two opposite sides of the top inside of the receiving chamber 21 define a pair of locking troughs 212 with a distance therebetween as well as the one between the locking portions 16 of the inner shell 10. A peripheral edge of a front end of the insulating body 20 protrudes outward to form a preventing portion 22. A top and a bottom of the insulating body 20 oppositely protrude to form a buckling hook 28 at a middle thereof and a rectangular resisting portion 29 connected with the preventing portion 22. Accordingly, a receiving space 27 is formed around outsides of the insulating body 20 and between the preventing portion 22 and the resisting portion 29.

Figure 6:
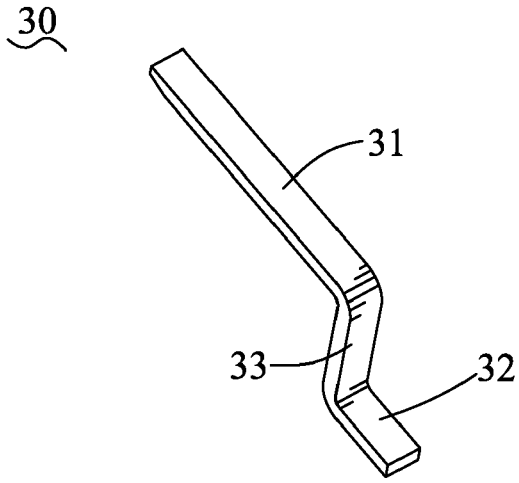
FIG. 6 is a perspective view of the terminal of the electrical connector of FIG. 1.

Referring to FIG. 5 and FIG. 6, each of the terminals 30 has a base arm 33 of which two opposite ends oppositely extend to form a soldering arm 32 and a contact arm 31 respectively. The terminals 30 are integratedly molded in the insulating body 20 at regular intervals along a perpendicular direction to an insert direction, wherein the base arms 33 are embedded in the rear wall 24 of the receiving chamber 21, the contact arms 31 are insert molded in the tongue 23 and further exposed to the receiving chamber 21, and the soldering arms 32 stretch out of a bottom of the rear wall 24 of the receiving chamber 21.

Referring to FIG. 3 and FIG. 4 again, the outer shell 40 has a rectangular base plate 41. Two opposite side edges of the base plate 41 extend downward to form two side plates 42 facing each other. Two bottom edges of the side plates 42 horizontally extend toward each other to form a pair of resisting plates 43 apart from each other. Two middle portions of junctions of the side plates 42 and the corresponding resisting plates 43 oppositely extend outward to form two soldering tails 44. A hole 46 is opened in a middle of the base plate 41 and vertically penetrates through the base plate 41. A middle of a rear edge of the base plate 41 is bent downward and then is arched forward to form a contact tail 47.

Figure 1:
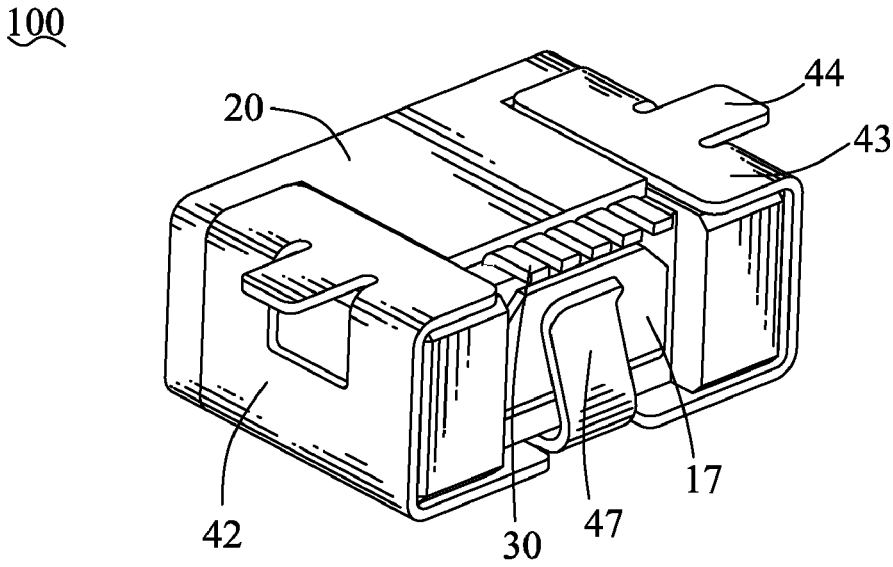
FIG. 1 is an assembled perspective view of an electrical connector in accordance with the present invention.

Referring to FIG. 1 and FIG. 2, in assembly, the inner shell 10 is mounted in the receiving chamber 21 of the insulating body 20 with the terminals 30, and the base, side and connecting boards 11, 12, 13 abut against the insides of the receiving chamber 21. The tongue 23 is further received in the receiving recess 14 and spaced from the base, side and connecting boards 11, 12, 13. The locking portions 16 are locked in the corresponding locking troughs 212. The contact slice 17 passes through the connecting slot 26 to be located in the receiving cavity 25 by means of an external tool and against an inner surface of the receiving cavity 25 so as to firmly restrain the inner shell 10 in the insulating body 20. Then the outer shell 40 is sleeved to the insulating body 20 and snapped in the receiving space 27. Front ends of the base, side and resisting plates 41, 42, 43 abut against the preventing portion 22, the resisting plates 43 tightly resist against two opposite sides of the resisting portion 29, and the buckling hook 28 is buckled in the hole 46, so that ensure the outer shell 40 sleeved to the insulating body 20 firmly. The contact tail 47 stretches into the receiving cavity 25 and electrically abuts against the contact slice 17 so as to achieve a ground function of the inner shell 10 through the outer shell 40. The soldering tails 44 are soldered to a printed circuit board (not shown) for fixing the electrical connector 100 on the printed circuit board.

As described above, the electrical connector 100 of the present invention can effectively prevent the water, which enters the receiving recess 14 of the inner shell 10 from an opened front end mouth of the receiving recess 14, from flowing onto the printed circuit board along the fillisters 15 of the inner shell 10 by means of the inner shell 10 being wrapped in the receiving chamber 21 of the insulating body 20 against the insides of the receiving chamber 21. Moreover, the contact slice 17 stretches out of the insulating body 20 to contact the contact tail 47 so as to achieve the ground function of the inner shell 10 through the outer shell 40, so that further prevent the water from flowing onto the printed circuit board along the contact slice 17.

What is claimed is:

1. An electrical connector, comprising:

an inner shell defining a receiving recess with two opposite ends being opened freely, a base board, two side boards and a connecting board being formed around the receiving recess, a rear edge of the base board being provided with a contact slice;

an insulating body defining a receiving chamber with a front end being opened freely for receiving the inner shell therein, a middle of a rear wall of the receiving chamber protruding forward into the receiving recess of the inner shell to form a tongue, a connecting slot being opened in a top of the rear wall and penetrating through the rear wall, the contact slice of the inner shell passing through the connecting slot and then being bent against a rear surface of the rear wall;

a plurality of terminals each having a contact arm insert-molded in the tongue of the insulating body and exposed to the receiving recess of the inner shell, and a soldering arm stretching out of the rear wall; and an outer shell enclosing the insulating body and having a base plate, a portion of a rear edge of the base plate being bent downward and then arched forward to form a contact tail which is located behind the rear wall and electrically abuts against the contact slice of the inner shell to achieve a ground function of the inner shell through the outer shell.

2. The electrical connector as claimed in claim 1, wherein two opposite sides of the base board respectively define a fillister penetrating therethrough, a front edge of the fillister extends upward to form a locking portion opposite to the receiving recess, two opposite sides of a top inside of the receiving chamber respectively define a locking trough for locking the corresponding locking portion therein.

3. The electrical connector as claimed in claim 1, wherein a top of the insulating body protrudes upward to form a buckling hook, a hole is opened in the base plate of the outer shell for buckling the buckling hook therein.

* * * * *